United States Patent [19]

Difflipp et al.

[11] Patent Number: 4,791,868

[45] Date of Patent: Dec. 20, 1988

[54] SHIFT-OVER DEVICE FOR CONTROLLING THE TURNING DRUM GRIPPERS OF A ROTARY SHEET PRINTING PRESS

[75] Inventors: Kurt Difflipp, Steinberg; Heinrich Ochs, Sinntal, both of Fed. Rep. of Germany

[73] Assignee: M.A.N.-Roland Druckmaschinen, Offenbach am Main, Fed. Rep. of Germany

[21] Appl. No.: 112,257

[22] Filed: Oct. 22, 1987

[30] Foreign Application Priority Data

Oct. 22, 1986 [DE] Fed. Rep. of Germany ... 8628072[U]

[51] Int. Cl.[4] ..... B41F 21/04

[52] U.S. Cl. ..... 101/230

[58] Field of Search ..... 101/230, 246, 229, 231, 101/409, 410; 271/275, 277, 82

[56] References Cited

U.S. PATENT DOCUMENTS 3,796,154 3/1974 Weisgerber ..... 101/230 X

FOREIGN PATENT DOCUMENTS 2708478 8/1978 Fed. Rep. of Germany ..... 101/230

*Primary Examiner*—Clifford D. Crowder

[57] ABSTRACT

A shift-over device for controlling the turning drum grippers of a rotary sheet printing press optionally changeable for one-side printing or two-side printing and having a relatively rotatable gripper opening cam and an axially movable gripper turning cam includes a rotatable switching shaft carrying a stop arm with adjustable stops mounted on the press frame for engaging the stop arm and limiting the rotation of the switching shaft in opposite directions. A first crank arm is secured to the switching shaft and carries a lash lever coupled to the gripper opening cam for relatively rotating it incident to oscillations of the switching shaft. A second crank arm is secured to the switching shaft and coupled to a push arm having face cams engageable with push rods connected to the gripper turning cam for axially shifting it incident to oscillations of the switching shaft. In the preferred embodiment, a pneumatic cylinder is connected to a drive crank secured to the switching shaft and a source of pneumatic pressure with a control valve interposed between the source and the pneumatic cylinder is provided for actuating the cylinder to oscillate the switching shaft and simultaneously rotate the gripper opening cam and axially shift the gripper turning cam.

3 Claims, 3 Drawing Sheets

SHIFT-OVER DEVICE FOR CONTROLLING THE TURNING DRUM GRIPPERS OF A ROTARY SHEET PRINTING PRESS

FIELD OF THE INVENTION

The present invention relates generally to a shift-over device for controlling the turning drum grippers of a rotary sheet printing press and more particularly concerns such a device for simultaneously controlling the gripper opening and gripper turning cams in a press that is optionally changeable between one-side printing and two-side printing.

BACKGROUND OF THE INVENTION

In rotary sheet printing presses for optional one-side printing or two-side printing, arrangements are necessary to shift over the control of the sheet running, so that in one case the sheets, held only by their leading edge, are conducted through the rotary sheet printing press and, in the second case, can be turned during the sheet running from their leading edge to their rear edge. In the technology of sheet turning, it is necessary to provide both grippers that can be swung with respect to one another for the transfer of the sheet end on a turning drum, and also to make it possible to shift the gripper opening point on the turning drum in such a way that the transfer time point corresponds to the running of the sheet end. For this purpose, turning cams have to be switched on the turning drum and the gripper opening cams shifted in correspondence to the shift-over of the sheet ends relative to the turning drum or with a correspondingly shifted opening point of the grippers.

In German patent application DE-AS No. 2,133,693 there is described a device for the control of the grippers of a sheet-transfer and turning drum of a multicolor rotary sheet printing machine. In this turning drum, there are turning cams and gripper opening cams. In normal operation of this rotary sheet printing press, the turning cam is out of engagement. For the gripper opening there are special cams in each case for one-side printing and for the two-sided printing operation. The turning cams and the gripper opening cams are shiftably disposed and coupled with one another over a special rod system. For the shift-over of the machine from one-side printing to two-side printing operation, the rod system is unlocked and shifted axially via a hand grip, so that simultaneously the turning cam and the gripper opening cam are axially shifted. The turning cam then comes into engagement, while the gripper opening cam for one-side printing comes out of engagement and the gripper opening cam for two-side printing likewise comes into engagement. Despite the relatively simple operation of the above-disclosed device, the time and expenditure of effort for the shift-over operation is relatively high. Moreover, it will be recognized that an operating procedure of several manual operations is necessary first for the shift-over of the turning cams and gripper opening cams.

OBJECTS AND SUMMARY OF THE INVENTION

Accordingly, the primary aim of the present invention is to provide an improved shift-over device for controlling the turning drum grippers of a rotary sheet printing press optionally changeable for one-side printing or two-side printing in which the switch-over of the turning cams and gripper opening cams can be performed automatically and no longer requires any manual operations.

Pursuant to the invention, the shift-over device includes a rotatable switching shaft carrying a stop arm with adjustable stops mounted on the press frame for engaging the stop arm and limiting the rotation of the switching shaft in opposite directions. A first crank arm is secured to the switching shaft and carries a lash lever coupled to the gripper opening cam for relatively rotating it incident to oscillations of the switching shaft. A second crank arm is secured to the switching shaft and coupled to a push arm having face cams engageable with push rods connected to the gripper turning cam for axially shifting it incident to oscillations of the switching shaft. In the preferred embodiment, a pneumatic cylinder is connected to a drive crank secured to the switching shaft and a source of pneumatic pressure with a control valve interposed between the source and the pneumatic cylinder is provided for actuating the cylinder to oscillate the switching shaft and simultaneously rotate the gripper opening cam and axially shift the gripper turning cam.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
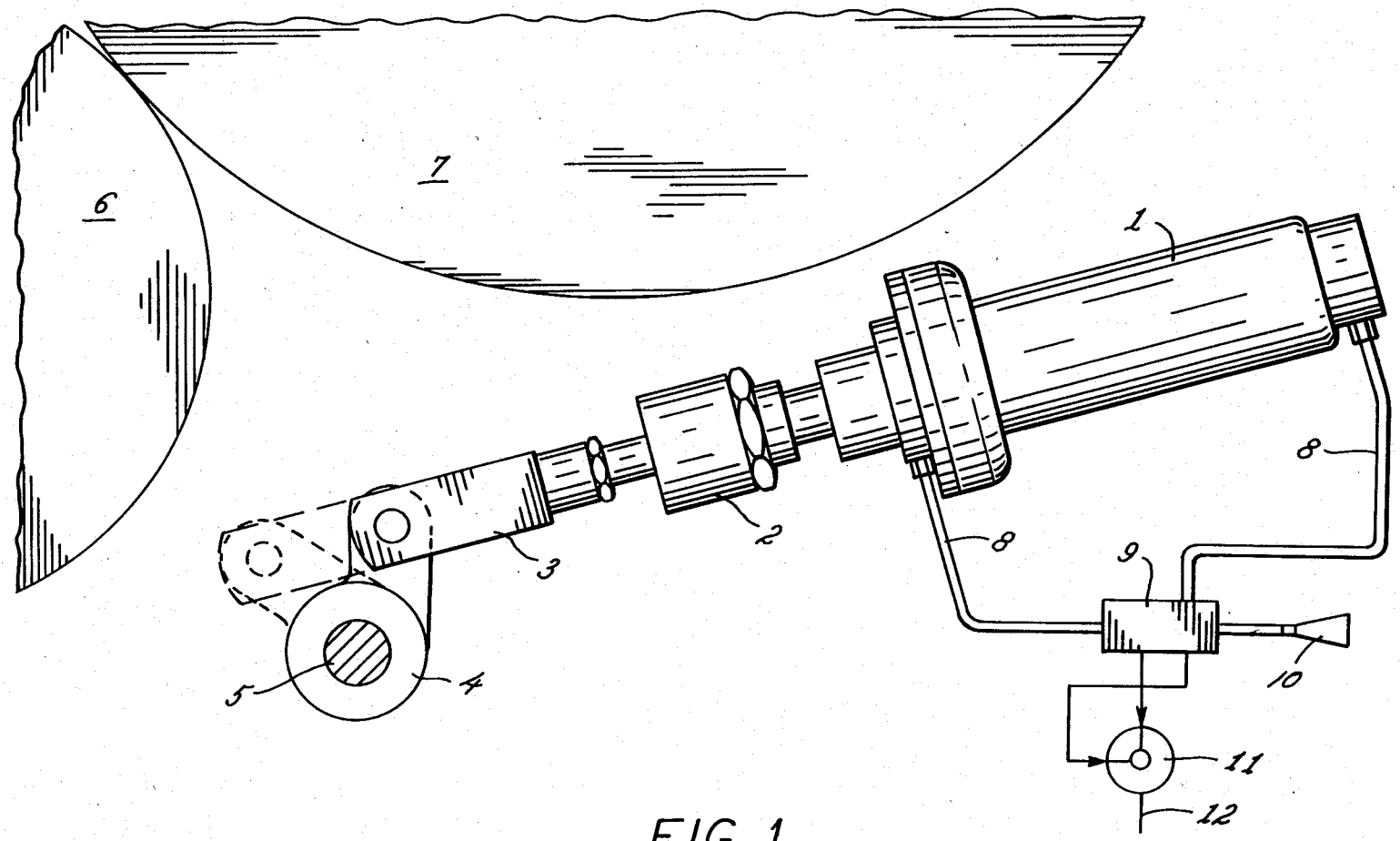
FIG. 1 is a fragmentary side elevation of a switching arrangement according to the present invention.

Turning now to the drawings, the shifting arrangement of the present invention is shown in FIG. 1 in the context of a portion of the printing press structure having a turning drum 6 and a storage drum 7. A pneumatic cylinder 1 is provided with a coupling 2 fastened by a fork 3 to a shifting crank or hub 4 which is secured on a rotatable switching shaft 5. The switching shaft 5 lies axially parallel to the turning drum 6 and the storage drum 7 of the printing press. The pneumatic cylinder 1 is connected by supply/return lines 8 to a pneumatic valve 9 connected to a pneumatic source 10. Desirably, the pneumatic valve 9 is operated by a throw switch 11 which also serves, in general, the purpose of preparing the printing press for the shift-over from one-side printing to the operation for two-side printing or vice versa. For this purpose, there are activated locking systems in the machine, a machine brake and various safety devices, not shown. The connection for the control of the rotary sheet printing press is indicated on the throw switch 11 by a suitable control connection 12.

Figure 2:
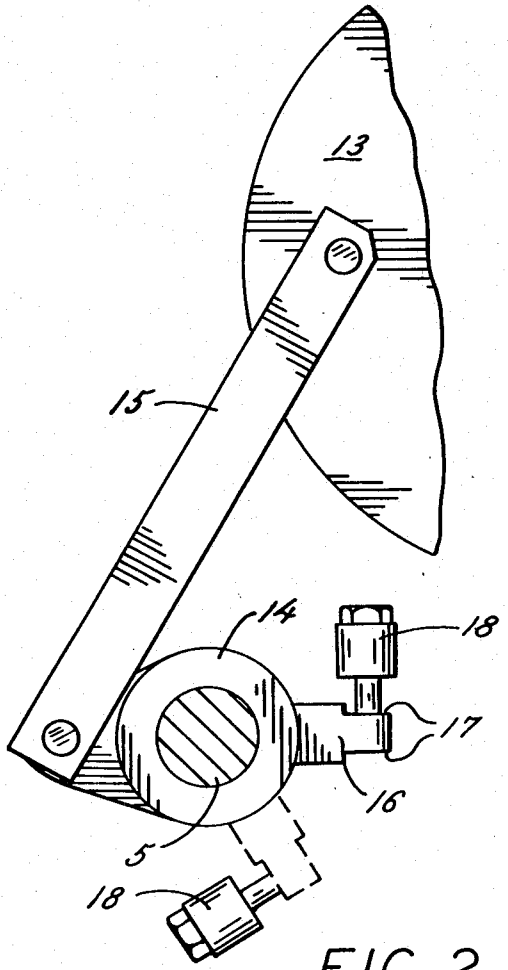
FIG. 2 is a fragmentary side elevation of the coupling of a gripper opening cam.

Pursuant to one aspect of the invention and as illustrated in FIG. 2 there is shown the connection of a gripper opening cam 13 to the switching shaft 5. For this purpose, a further switching hub or crank 14 is fastened to the switching shaft 5 and connected to the crank 14 there is an articulated lash lever 15. The lash lever 15, in turn, is connected with the gripper opening cam 13, which is mounted relatively rotatably on a shaft part of the turning drum 6. Further to the crank hub 14 there is fastened an extension arm 16 provided with opposed stop surfaces 17. For abutting the stop surfaces 17, a pair of adjustable end stops 18 are fastened on the machine frame.

Figure 3:
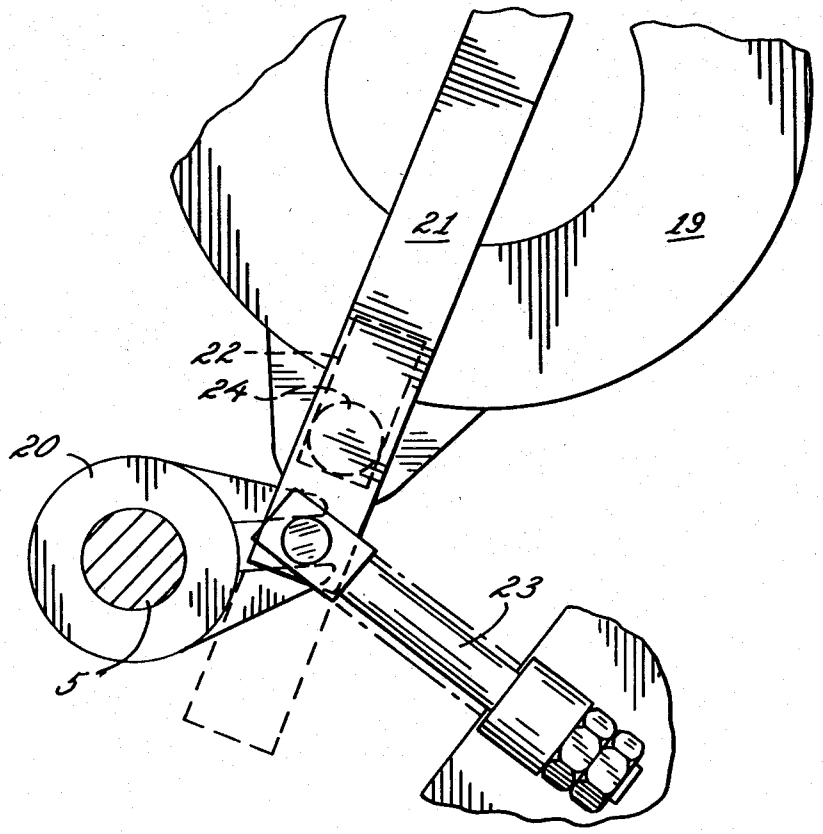
FIG. 3 is a fragmentary side elevation of the coupling of a turning cam.

In accordance with another aspect of the invention, and as shown in FIG. 3, there is represented the coupling of a turning cam 19 with the switching shaft 5. For this purpose, a third switching hub or crank 20 is fastened to the switching shaft 5. The crank 20 is coupled to an articulated push arm 21 which carries a pair of face cams 22. The push arm 21 is moved linearly upon oscillation of the shaft 5 and its connecting pin is secured in position by a spring rod 23 with respect to the switching hub 20. The linear movement of the coupling of the switching hub 20 with the push arm 21 through the coupling pin and slotted end of the crank 20 causes the spring rod 23 to toggle between alternate positions.

Figure 4:
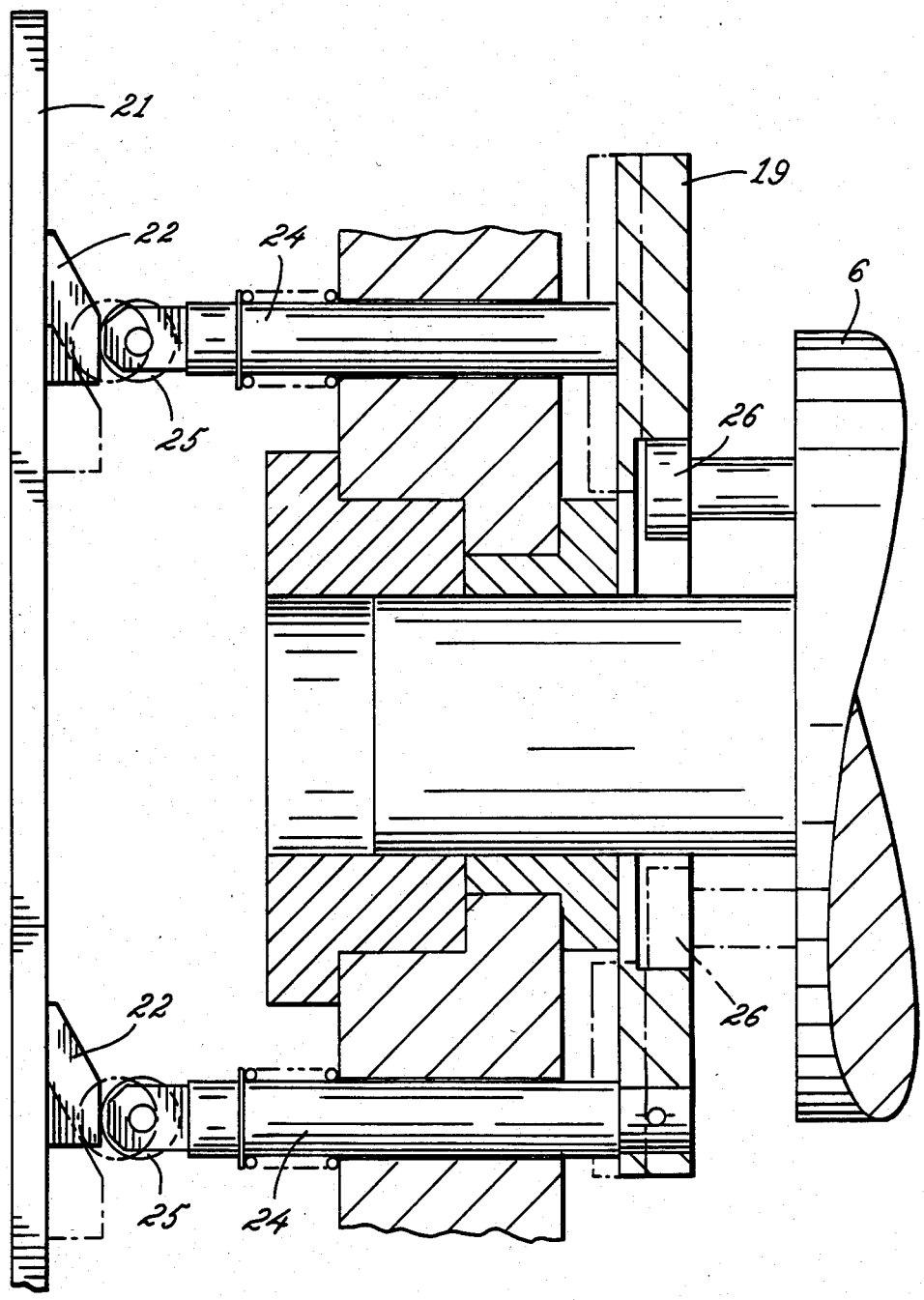
FIG. 4 is an axial section of the turning cam coupling shown in FIG. 3.

Turning now to FIG. 4, the disposition of turning cam 19 to the push arm 21 is shown. The turning cam 19 is provided with guide rods 24 which make it movable axially relative to the turning drum 6. At the outer end of the guide rods 24 cam rolls 25 are provided which are supported on the face cam 22 on the push arm 21. The guide rods 24 are pressed under spring force against the face cams 22 and by longitudinal shifting of the push arm 21, the turning cam 19 can be brought into operative position with cam rolls 26 on the turning drum 6.

The functioning of the shifting arrangement of the present invention may be described as follows:

For the shift-over of the rotary sheet printing press from one manner of operation to the other, first the throw switch 11 is operated. The printing press is then locked and secured. Simultaneously, however, the pneumatic valve 9 is actuated and according to its starting position, the pneumatic cylinder 1 is moved into one or the other of its end positions. In the process, the extension 16 on the switching hub 14 strikes with one of its stop surfaces 17 on one of the two end stops 18, depending on direction of movement. The size of the rotary angle or the position of the swinging movement of the shifting shaft 5 is variable by adjustment of the end stops 18.

By rotation of the switching shaft 5, a movement is transferred from the switching hubs or cranks 14 and 20 for the adjustment of the gripper opening cam 13 and of the turning cam 19. The lash lever 15 transfers a rotary movement to the gripper opening cam 13 while the push arm 21 transfers an axial movement over its face cams 22 onto the turning cam 19. Accordingly, either the opening time point of the gripper on the turning drum 6 is set in for oneside printing and simultaneously the turning cam 19 is brought out of engagement with the cam rolls 26, or the gripper opening cam 13 is shifted over to the opening time point for reverse printing operation and the turning cam 19 is brought into engagement with the cam rolls 26. It will also be understood that the position of the gripper opening cam 13 is adjustable by the end stops 18 as described above. The shift-over takes place without any additional participation by the operating personnel and the device of the present invention makes sure that the disposition of the cams for the operation in one of the two operating manners is performed correctly for the corresponding function.

We claim as our invention:

1. A shift-over device for controlling the turning drum grippers of a rotary sheet printing press optionally changeable for one-side printing or two-side printing and having a relatively rotatable gripper opening cam and an axially movable gripper turning cam, said device comprising, in combination, a rotatable switching shaft carrying a stop arm, adjustable stop means mounted on the press frame for engaging said stop arm and limiting the rotation of said switching shaft in opposite directions, means including a first crank arm secured to said switching shaft and carrying a lash lever coupled to said gripper opening cam for relatively rotating said gripper opening cam incident to oscillations of said switching shaft, means including a second crank arm secured to said switching shaft and coupled to a push arm having face cams engageable with push rods connected to said gripper turning cam for axially shifting said gripper turning cam incident to oscillations of said switching shaft, and control means for oscillating said switching shaft and stop arm between said adjustable stop means.

2. A shift over device as defined in claim 1 wherein said control means includes a pneumatic cylinder connected to a drive crank secured to said switching shaft, a source of pneumatic pressure and a control valve interposed between said source and said pneumatic cylinder for actuating said cylinder to oscillate said switching shaft and simultaneously rotate said gripper opening cam and axially shift said gripper turning cam.

3. A shift over device as defined in claim 1 wherein said second crank arm includes a radially slotted end for receiving a cross pin coupled to said push arm and said cross pin is carried on a bushing slidably mounted on guide rods and biased by a spring thereon into alternately toggled positions as said switching shaft and stop arm oscillate between said adjustable stop means.

* * * * *